US005556026A

United States Patent [19]

Blankitny

[11] Patent Number: 5,556,026

[45] Date of Patent: Sep. 17, 1996

[54] BOX

[75] Inventor: Efraim Blankitny, Natanya, Israel

[73] Assignee: Blank Paper Products Ltd., Akiva, Israel

[21] Appl. No.: 558,616

[22] Filed: Nov. 14, 1995

Related U.S. Application Data

[63] Continuation of Ser. No. 239,250, May 6, 1994, abandoned.

[30] Foreign Application Priority Data

Jun. 3, 1993 [IL] Israel ..... 105898
Mar. 24, 1994 [IL] Israel ..... 109106

[51] Int. Cl.[6] ..... B65D 17/32

[52] U.S. Cl. ..... 229/123.1; 229/206; 229/229; 229/247

[58] Field of Search ..... 229/125.37, 137, 229/123.1, 206, 212, 221, 229, 232, 245, 247, 211

[56] References Cited

U.S. PATENT DOCUMENTS

| | | | |
|---|---|---|---|
| 2,407,781 | 9/1946 | Guyer . | |
| 2,773,634 | 12/1956 | Negoro | 229/206 |
| 3,110,434 | 11/1963 | Linda et al. | 229/229 |
| 3,568,917 | 3/1971 | Vergobbi | 229/125.37 X |
| 3,661,321 | 5/1972 | Tessmer, Jr. | 229/212 |
| 3,687,352 | 8/1972 | Kalajian . | |
| 3,940,054 | 2/1976 | Goebel et al. | 229/206 X |
| 3,951,333 | 4/1976 | Forbes, Jr. et al. | 229/206 X |
| 4,158,412 | 6/1979 | Wysocki | 229/242 X |
| 4,458,810 | 7/1984 | Mahoney | 229/229 X |
| 4,690,282 | 9/1987 | Ghini | 229/137 X |
| 4,746,019 | 5/1988 | Prater | 206/625 |
| 4,865,203 | 9/1989 | Ueda | 229/206 X |
| 5,076,439 | 12/1991 | Kuchenbecker | 229/206 X |

FOREIGN PATENT DOCUMENTS

| | | | |
|---|---|---|---|
| 1017965 | 12/1952 | France . | |
| 2285305 | 4/1976 | France . | |
| 1012249 | 7/1957 | Germany . | |
| 288605 | 5/1953 | Switzerland . | |
| 1194016 | 6/1970 | United Kingdom | 229/206 |

*Primary Examiner*—Allan N. Shoap
*Assistant Examiner*—Christopher J. McDonald
*Attorney, Agent, or Firm*—Fitch, Even, Tabin & Flannery

[57] ABSTRACT

A novel box has an envelope made of cardboard coated by a coating which is essentially impermeable to fluids. The box is particularly suitable as a container of scented and wet tissue paper.

4 Claims, 6 Drawing Sheets

BOX

This application is a continuation of application Ser. No. 08/239,250 filed May 6, 1994, abandoned.

FIELD OF THE INVENTION

The present invention relates to a box, specifically such adapted for holding scented or even wet tissue paper sheets.

BACKGROUND OF THE INVENTION

Scented tissue papers are soaked with volatile essence molecules which confer upon the tissue paper a characteristic scent. In order to avoid evaporation of these volatile molecules, the tissue papers have to be stored in an essentially gas-impermeable container, typically made of plastic. However, plastic containers have a significant disadvantage in both weight, price and handiness and furthermore, after use, plastic containers constitute an ecological hazard. The need to store tissue paper in plastic containers is even more pronounced where the tissue papers are soaked with a liquid, such as those used for baby hygiene.

Cardboard boxes, which do not have the above characteristic drawbacks of plastic containers, are often used to hold various dry tissue paper sheets or paper towels. However, in view of the fact that cardboard is a material which is permeable to vapor, it cannot be used for holding scented or wet tissue paper sheets or the like. Attempts have been made to construct cardboard boxes where the cardboard is coated by an impermeable coating, but these do not yield a sufficiently satisfactory result since the opening designed for withdrawal of the tissue paper sheets as well as the end faces constructed from overlapping flaps extending from adjacent faces of the box, readily enable evaporation of the substance with which the tissue paper sheets are soaked.

Scented disposable tissues and a container therefor has been disclosed in U.S. Pat. No. 4,458,810. A resealable dispenser-container suitable for containing sheet-like materials such as tissue paper, and the manner of its construction have been disclosed in U.S. Pat. No. 4,420,080. A moisture-impermeable packet adapted for holding moisture-impregnated articles with an accessible resealable opening has been disclosed in U.S. Pat. No. 4,156,493. Another resealable container with a tearable face which can be opened and resealed by a label has been disclosed in U.S. Pat. No. 4,679,693.

SUMMARY OF THE INVENTION

The present invention provides a box having an envelope made of cardboard, at least one face of which being coated by a coating which is essentially impermeable to fluids; the box having two end faces, each of which being constructed by folding overlapping flaps extending from adjacent faces of the box, the openings left at the end faces after folding are sealed by a patch of adhesive film which is essentially impermeable to fluid; at least one face of said box, other than said end faces, having a resealable closure assembly comprising a flap integral with the envelope at one side thereof which forms a hinge between said flap and the envelope, said assembly further comprises an adhesive label covering said flap and extending over its boundaries to adjacent portions of the envelope, whereby it seals the opening; said label has a tab at a portion thereof remote from the hinge for opening the closure.

The present invention also provides a box in which the end faces are being formed by a novel way of folding. In accordance with this embodiment of the invention, the box has a rectangular prismatic shape having top, bottom, two side and two end faces, each end face being constructed by:

first flap integral with and extending from either one of the top or bottom faces;

two second flaps integral with and extending from the side faces, and being integral with a third flap which is integral with and extending from the other of said top or bottom faces;

a first, second and third fold lines are provided between the first, second and third flaps and their integral faces, respectively; a fourth fold line is provided between each of said second flaps and said third flaps; and a fifth fold line is provided on each of said second flaps, which extends diagonally from one apex of the second face formed at the point of intersection between the second and fourth fold lines, to the opposed apexes of the second faces;

said end faces are formed by first folding internally along second, third and fourth fold line and externally along the fifth fold line, until said third flap is normal to the top, bottom and side faces of the box and then folding said first flap internally along said first fold line and fixing said first flap over said third flap.

The present invention will now be further illustrated by description of the following specific embodiments with occasional reference to the annexed drawings.

DESCRIPTION OF A SPECIFIC EMBODIMENT

Figure 1:
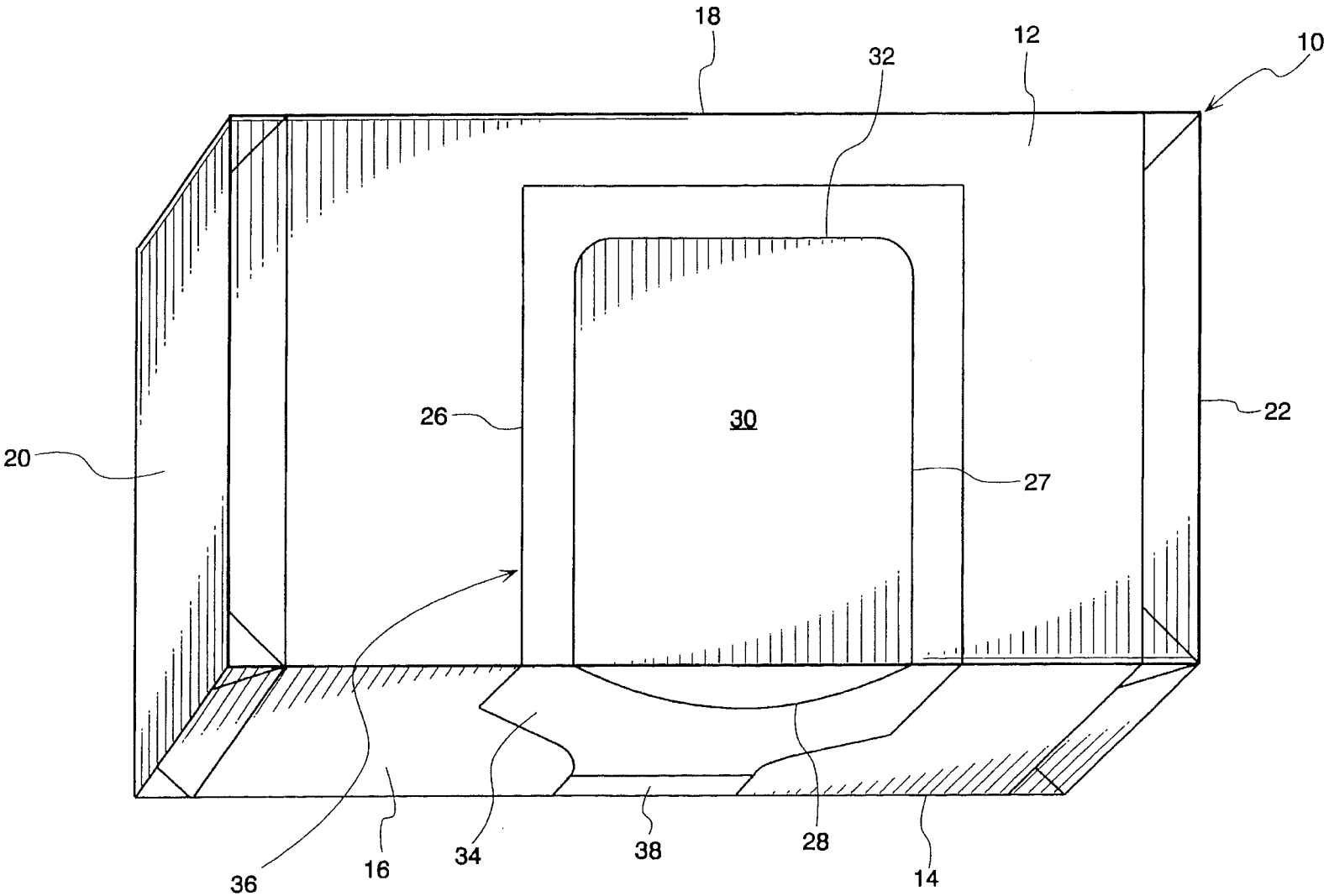
FIG. 1 shows a perspective view of a box in accordance with an embodiment of the invention with the closure assembly in closed state.

Reference is first being made to FIG. 1 showing a box generally designated 10 having an upper face 12, a bottom face 14, two side faces 16 and 18 and two end faces 20 and 22.

The box is made of cardboard which is externally coated by a layer of a material which is impermeable to liquids or vapors, such as polyethylene, polypropylene or the like. The coating is preferably transparent whereby the print on the cardboard may be seen. The coating may either be on the external face of the box, the internal face or both. Where, for example, box 10 is intended as a container for scented tissue paper, an external coating would suffice. Where, for example, the box is intended as a container for tissue paper impregnated with a liquid, such as those used for baby hygiene, the cardboard will be coated on its internal face, so as to avoid soaking of the cardboard sheet with liquid impregnated in the paper sheets; preferably in such a case the cardboard will be also externally coated by a similar kind of coating.

The upper face 12 and side face 16 are cut along lines 26, 27 and 28 so as to form a flap 30 which is integral with face 12 along fold line 32. Flap 30 together with label 34 form a closure assembly generally designated 36.

Figure 2:
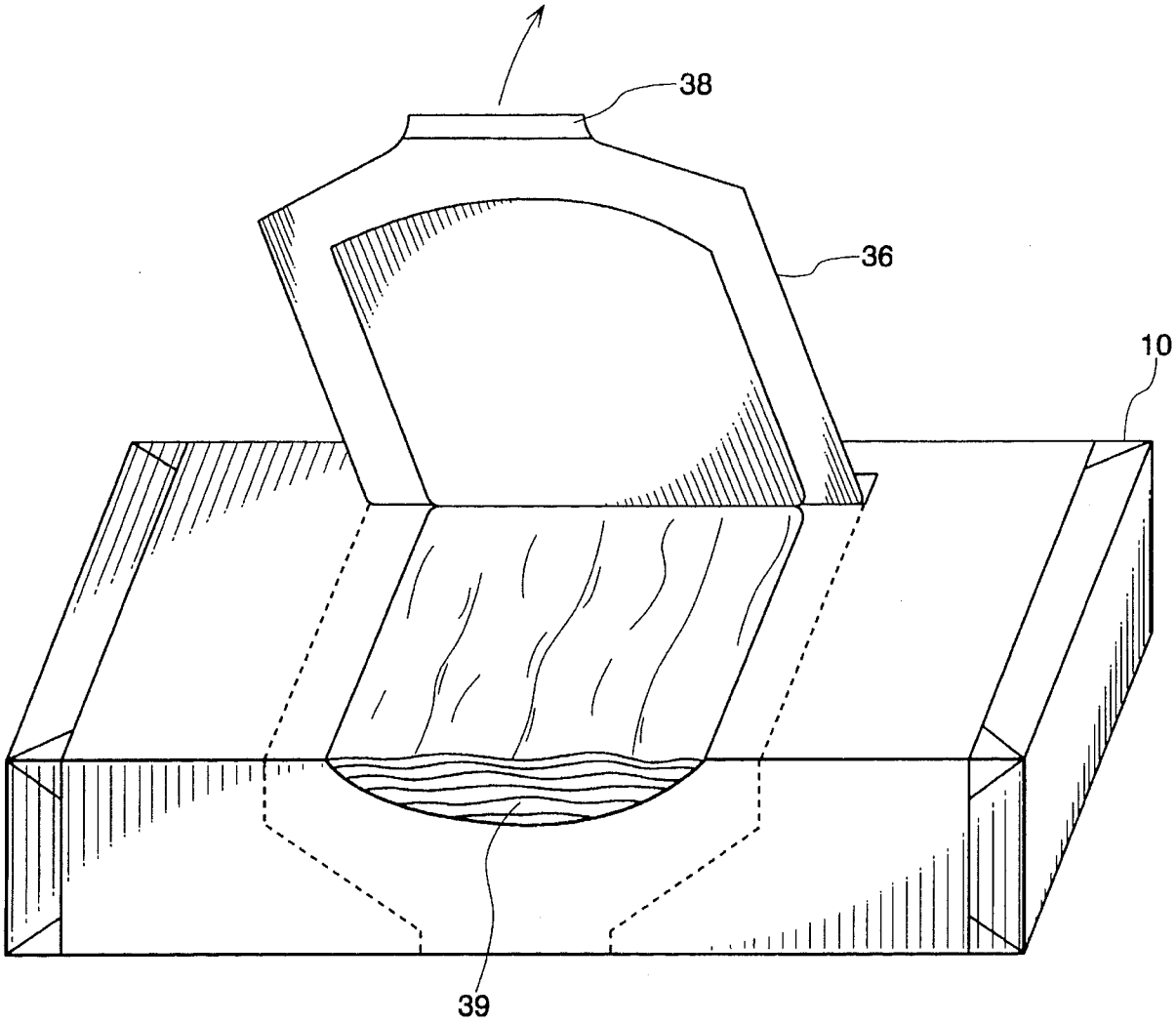
FIG. 2 shows a different perspective view of the box of FIG. 1, with the closure assembly open.

Label 34 which is made of a film having a lower adhesive face, covers flap 30 and extends beyond its edges to the surrounding portions of the box's envelope. Owing to its adhesiveness, the label completely seals the opening. Label 34 has a portion 38 which does not have an adhesive bottom face, which serves as a tab which allows easy opening of the closure assembly, as shown in FIG. 2. In this specific embodiment, the non-adhesive portion 38 is formed by folding over a small portion of the film.

In FIG. 2 the closure assembly is open revealing the contents of tissue paper 39 contained within box 10.

The end faces 20 and 22 are sealed by means of an adhesive patches 39 and 40 which cover the opening left after folding of the flaps extending from the top, bottom and side faces to form the end faces 20 and 22.

Figure 3:
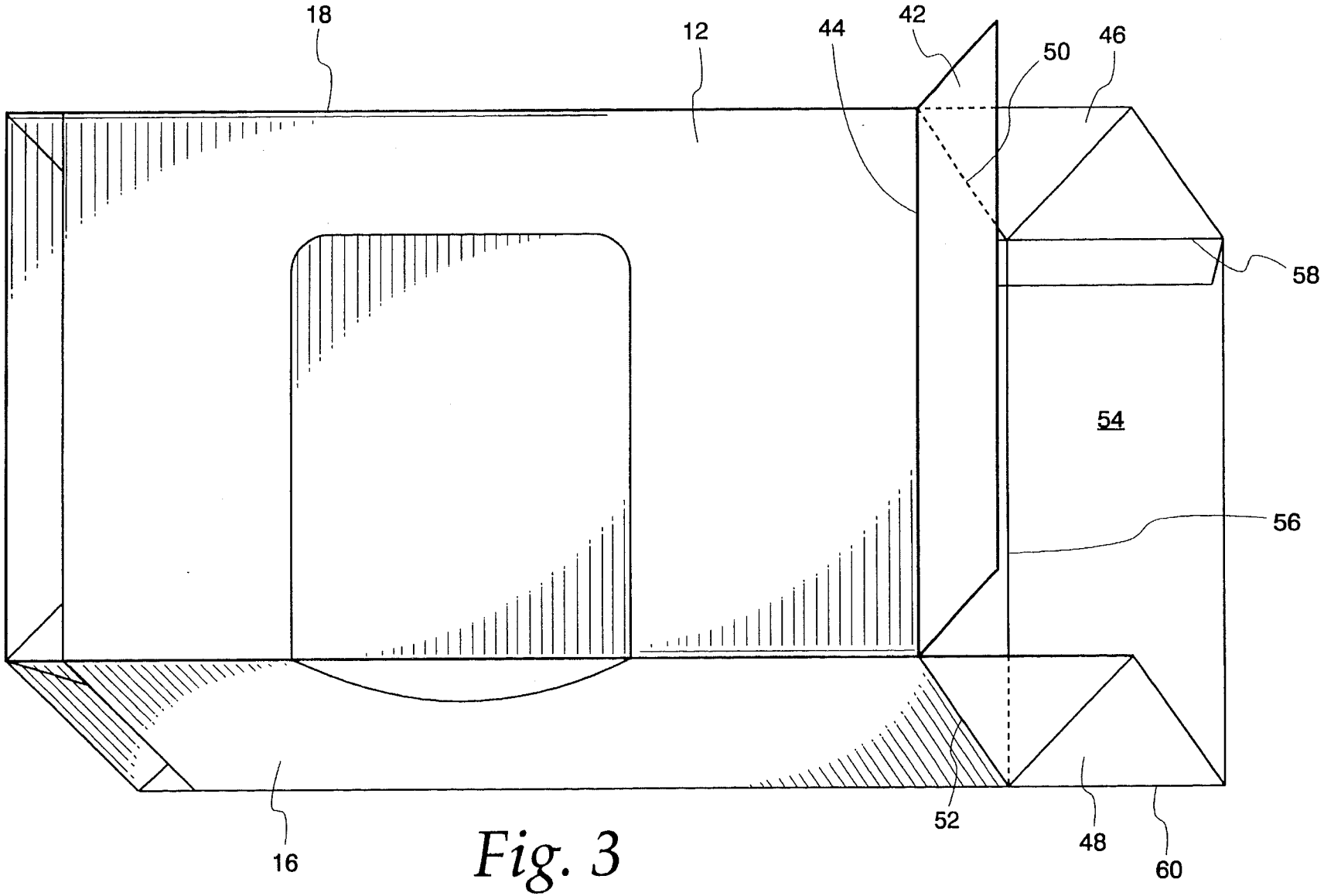
FIG. 3 shows a box in accordance with the invention in a state in which one end face thereof is open.

Reference is now being made to FIG. 3 showing one of the end faces before its folding. The end face is formed by flap 42 integral with and extending from top face 12 and separated therefrom by a first fold line 44. Flaps 46 and 48 which are integral with and extend from side faces 16 and 18, are separated therefrom by second fold lines 50 and 52. Flaps 46 and 48 are also integral with third flap 54 which is integral with and extends from bottom face 14 and separated therefrom by fold line 56. Fold lines 58 and 60 separate flaps 46 and 48 from flap 54. Extending diagonally through flaps 46 and 48 are two respective diagonal fold lines 62 and 64.

Figure 4:
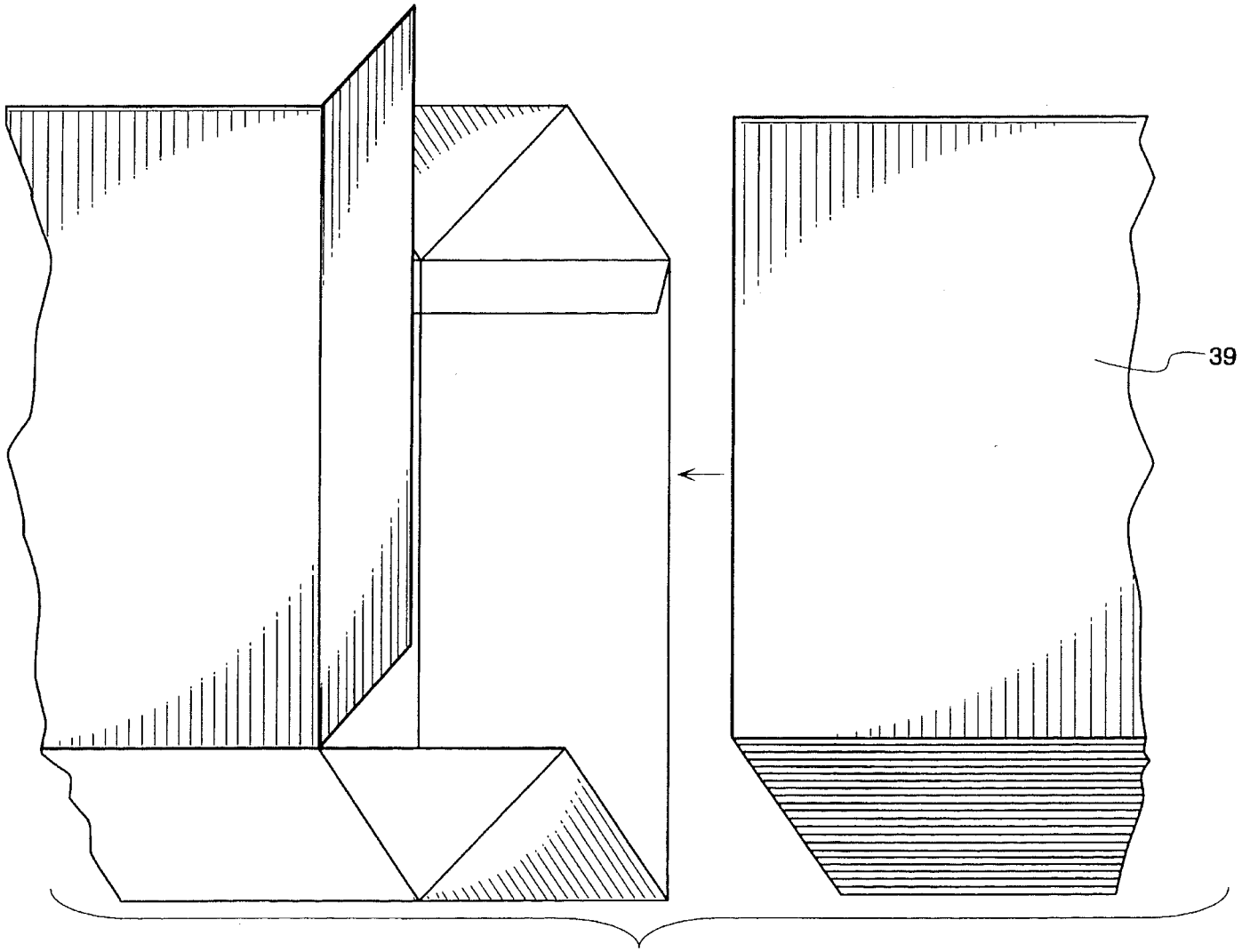
FIG. 4 shows the manner of insertion of a bundle of tissue papers into the box.

As shown in FIG. 4, a bundle of tissue paper sheets 39 can be inserted through the open end and then the open end can be closed by folding along the fold lines as represented in FIG. 5, which shows the sequence of closure of the open end. For closing, the flaps 46, 48 and 54 are folded internally along fold lines 50, 52, 56, 58 and 60 and externally along diagonal fold lines 62 and 64 as shown in FIGS. 5*a* and 5*b* to yield the state as shown in FIG. 5*c* wherein flap 54 comes to lie so as to be normal to the adjacent faces of the box. Then flap 42 is folded internally along fold line 44 whereby it comes to lie parallel to flap 54 and is fixed in this position as shown in FIG. 5*d*. The above type of formation of the end face forms a tight and rigid closure which aids in both stiffening the structure of the box as well as in effective sealing thereof.

Figure 5B:
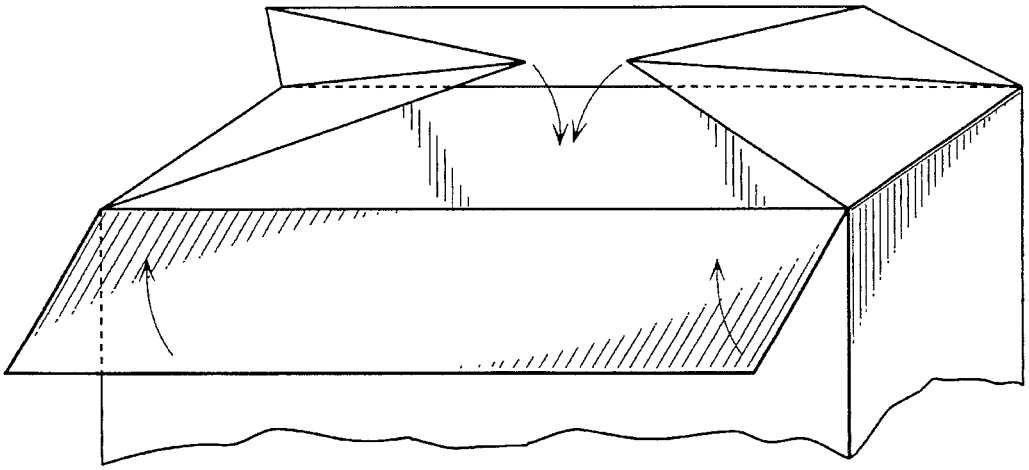
FIG. 5 shows the sequence of closing of an open end face of the box.
Figure 5A:
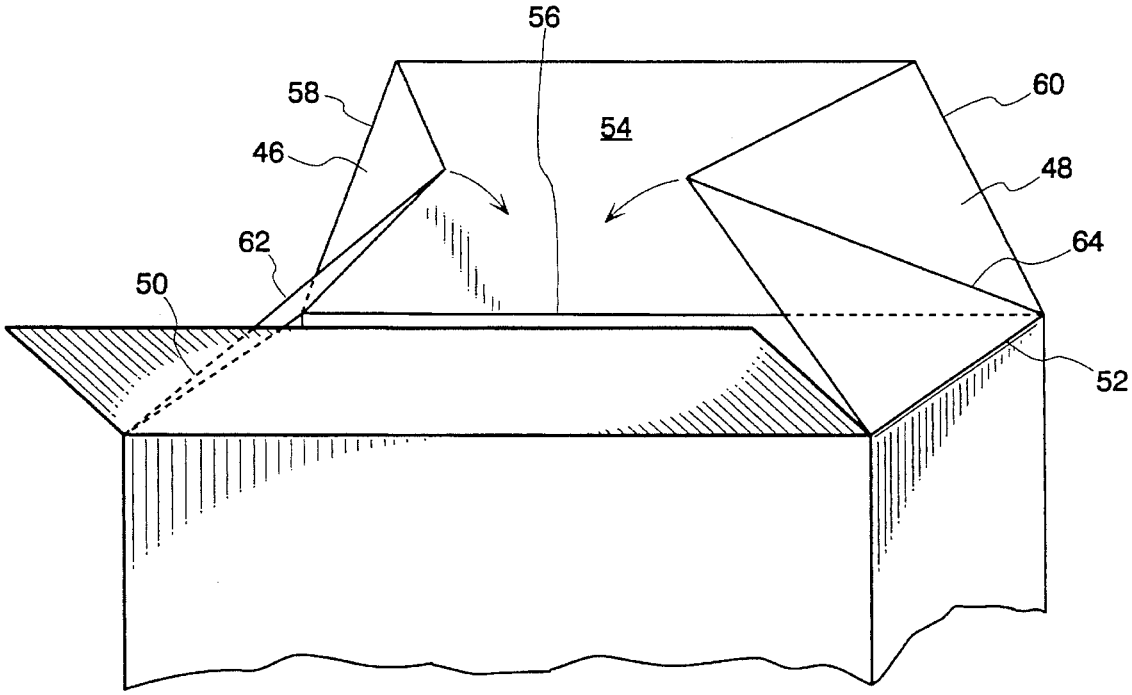
Figure 5C:
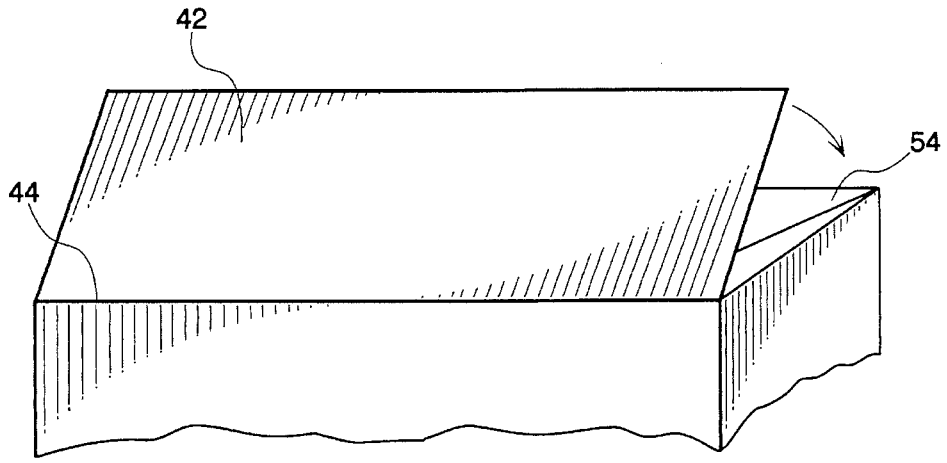
Figure 5D:
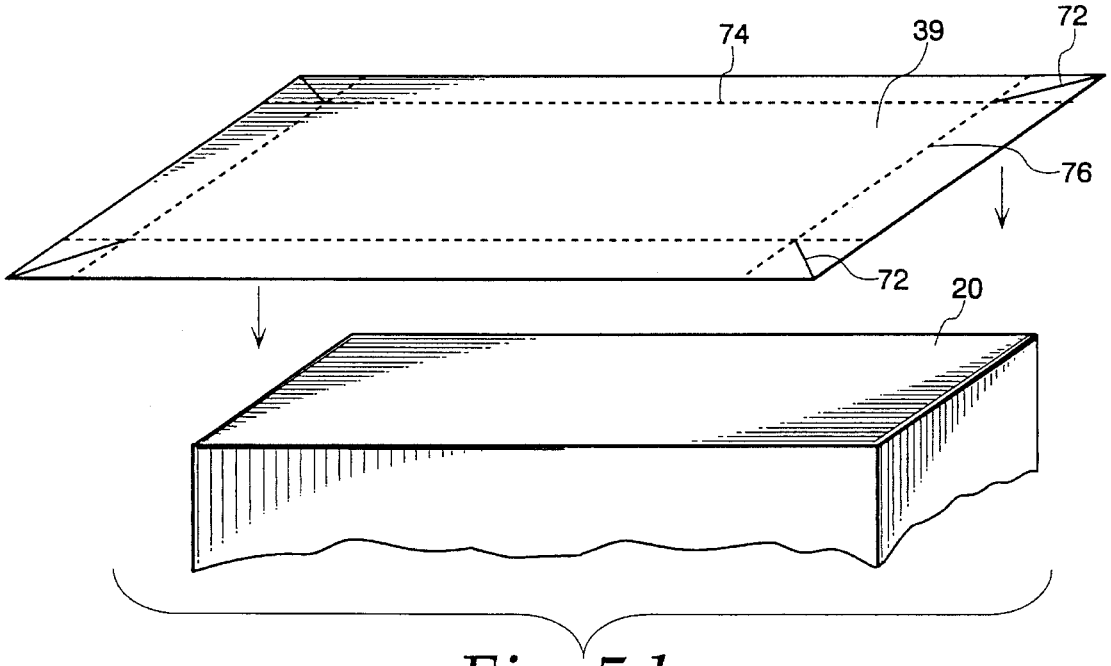
Figure 5E:
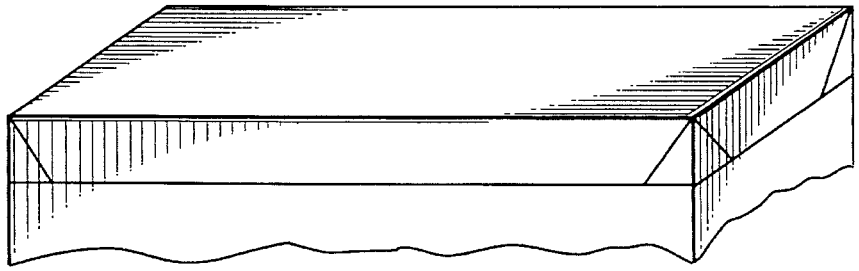

In order to improve the seal, an adhesive patch 39 is fixed to end face 20 and by virtue of having diagonal slits 72 and fold lines 74 and 76, as can also be seen in FIG. 5*d*, it is fixed over end face 20 to yield the state as shown in FIG. 5*c*.

I claim:

1. A box having an envelope made essentially of cardboard for containing a product, at least one face of the cardboard being coated by a coating which is essentially impermeable to fluids; the box having a rectangular prismatic shape with two first side walls, two second side walls and two end walls, each end wall being constructed by a first flap, two second flaps and a third flap; the first flap being integral with and extending from either one of the first side walls; the two second flaps being integral with and extending from the second side walls, and being integral with the third flap, the third flap being integral with and extending from the other of said first side walls; there being a first, second and third fold lines between the first, second and third flaps and their integral side walls, respectively; there being a fourth fold line between each of said second flaps and said third flaps; and there being a fifth fold line on each of said second flaps, which extends diagonally from one apex of the second flap formed at the point of intersection between the second and the fourth fold lines, to the opposed apex of the second flap; said end walls are formed each by first folding internally along the second, third and fourth fold lines and externally along the fifth fold line, until said third flap is normal to the first and second side walls of the box and then folding said first flap internally along said first fold line and fixing said first flap over said third flap;

the openings left at the end walls after folding of the flaps are sealed by a patch of adhesive film which is essentially impermeable to fluid;

at least one of said side walls having a resealable closure assembly defining an opening in the envelope for product access and comprising a flap integral with the envelope at one side thereof which forms a hinge between said flap and the envelope, said assembly further comprises an adhesive label covering said flap and extending over its boundaries to adjacent portions of the envelope, to seal the opening prior to a first use and to reseal the opening between uses; said label having a tab at a portion thereof remote from the hinge for opening the closure.

2. A box according to claim 1, wherein the patch of adhesive film is a rectangle having an area larger than that of the end walls, the patch being attached to the end wall at a central portion thereof and having peripheral portions for attachment to the side walls.

3. A box according to claim 2, wherein the adhesive label of the resealable closure assembly extends into two adjacent side walls.

4. A box according to claim 1 wherein the product comprises tissues impregnated with fluid and the end walls, adhesive film patch and adhesive label serve to retain the fluid inside the box.

* * * * *